United States Patent [19]

Ash

[11] Patent Number: 4,633,638

[45] Date of Patent: Jan. 6, 1987

[54] REPLACEMENT OF WALL TIES AND APPARATUS AND TIES FOR USE THEREIN

[75] Inventor: Dennis E. Ash, Sutton Coldfield, England

[73] Assignee: Tarmac Construction Limited, Wolverhampton, England

[21] Appl. No.: 562,695

[22] Filed: Dec. 19, 1983

[51] Int. Cl.[4] ..... E04B 1/02

[52] U.S. Cl. ..... 52/562; 52/378; 52/513

[58] Field of Search ..... 52/378, 379, 565, 714, 52/508, 513, 235

[56] References Cited

U.S. PATENT DOCUMENTS

| | | | |
|---|---|---|---|
| 679,324 | 7/1901 | McCall | 52/714 |
| 1,470,727 | 10/1923 | Hall | 52/378 |
| 1,764,729 | 6/1930 | Koch | 52/714 X |
| 2,130,531 | 9/1932 | Arand | 52/714 X |
| 2,588,631 | 3/1952 | James | 52/378 X |
| 3,341,998 | 9/1967 | Lucas | 52/379 |
| 3,377,764 | 4/1968 | Storch | 52/379 X |
| 3,471,988 | 10/1969 | Allen | 52/714 |
| 3,786,605 | 1/1974 | Winfrey | 52/378 X |

FOREIGN PATENT DOCUMENTS

| | | | |
|---|---|---|---|
| 143124 | 8/1951 | Australia | 52/513 |

*Primary Examiner*—Carl D. Friedman
*Assistant Examiner*—Creighton Smith
*Attorney, Agent, or Firm*—Marshall, O'Toole, Gerstein, Murray & Bicknell

[57] ABSTRACT

A wall tie in a cavity wall is replaced by removing a masonry element from the outer leaf of the wall, gripping an exposed part of the wall tie, pulling the wall tie from the inner leaf, drilling a hole in the inner leaf, grouting a part of a replacement tie in the hole and then replacing the masonry element.

3 Claims, 5 Drawing Figures

REPLACEMENT OF WALL TIES AND APPARATUS AND TIES FOR USE THEREIN

BACKGROUND OF THE INVENTION

This invention relates to a method and apparatus for removing wall ties, to a procedure involving the method and the apparatus for replacing wall ties and to wall ties for use in the procedure.

In cavity wall construction, wall ties are used to link the inner and outer leaves of masonry at intervals, typically of four or five courses of masonry elements such as bricks. In recent cavity wall construction, such ties have been made of galvanised steel and very recently plastics material such as polypropylene have been proposed for use in wall ties.

However, in early cavity wall construction in the 1920's and 30's, mild steel wall ties having water resistant enamel coatings were used, since galvanised ties were not then available.

During the life of a cavity wall, water penetrating the outer leaf may attack and severely corrode unprotected mild steel wall ties. This may take place for example at defects in the enamel coating. The corroded steel expands and splits into weak flakes, heavily oxidised, and having a much greater thickness than the original ties.

This expansion of the corroded steel ties causes opening of the mortar joints and lifting of the masonry above. Horizontal cracks appear in the outer leaf of masonry along the mortar joints in which the wall ties have been positioned. In severe cases, the lifting of the outer leaf of the wall may cause grave structural defects. Additionally, the loss of strength in the ties can result in the leaves of the cavity wall bulging apart. These effects could cause collapse of the wall.

Previously proposed remedial methods have been unsatisfactory.

For example, it has been proposed to locate the original ties, remove the mortar of the outer leaf of masonry and then, using a bolster chisel, hammer the original tie away from the outer leaf so that it no longer bridges the cavity. The inner and outer leaves must then be reconnected and this is done by drilling through the masonry elements such as brickes, inserting an expansible tie rod and mechanically or frictionally engaging the tie rod with the masonry of the inner and outer leaves.

This method may cause damage to the inner leaf, because the remnants of the original tie may be driven through the inner leaf and the transmission of the hammering forces may damage internal plaster work. Additionally, the insertion of substitute ties through the outer leaf by drilling through the brickwork leaves unsightly traces that tie replacement has been carried out. The expansible ties used are extremely expensive and are not particularly secure because they rely merely on friction to hold them in place.

Another method which has been suggested to resecure the inner and outer leaves together is the use of urethane foam bonding material which bonds to the inner and outer leaves within the cavity and holds them together. While this prevents the masonry leaves from bulging apart, it does not prevent the corrosion and "growth" of the original ties which can still cause severe structural damage to the bulding by forcing apart the courses of masonry in the outer leaf.

A substitute form of tie which has been proposed as an alternative to the friction tie referred to above involves the insertion through drilled holes in the inner and outer leaves of a tube which carries at one end a double capsule of components which will form an epoxy mortar when mixed together. A threaded rod is forced into the tube, the rod having a spade drill formed leading end which penetrates the capsule, releasing the epoxy material, which then forms the mortar around the threaded rod and embedded in the inner leaf. The part of the threaded rod embedded in the outer leaf is then grouted in with an epoxy mortar. The resulting tie is much more secure than the previously described friction tie but is again inserted through drilled holes in the masonry, the operator being unable to see what is happening at the inner leaf. The resulting drilled holes remain visible after remedial work has been carried out.

As referred to above, the more insertion of a new wall tie to secure the inner and outer leaves together only partly cures the problem in that it is still necessary to remove the expanding corroding wall ties from at least the outer leaf of the wall. There may typically be two hundred and fifty wall ties involved in a modest sized house.

A further, drastic remedy is available to cure the problem of wall tie corrosion and this is to demolish the outer leaf of masonry, remove the wall ties manually and rebuild the outer course of masonry, inserting ties in the inner and outer leaves as work progresses. This is extremely costly although very effective.

SUMMARY OF THE INVENTION

It is an object of the present invention to provide a method for removing wall ties from a cavity wall.

According to a first aspect of the invention, there is provided a method of removing a wall tie from a cavity wall comprising detecting the approximate position of the wall tie from outside the outer leaf of the wall, removing a masonry element from the outer leaf immediately adjacent said approximate position to expose the wall tie, gripping the exposed wall tie by means of a tool and pulling the tie from the inner leaf by means of the tool.

The tie may be located by a metal detector.

The tool may include fluid operated piston and cylinder means, in which case the method may include the steps of abutting a portion of the tool against the remaining masonry of the outer leaf and operating the piston and cylinder means to pull the wall tie, the reaction of the force exerted on the wall tie being applied to the outer leaf of the wall.

The operation of the piston and cylinder means may also operate gripping means to grip the wall tie before and/or simultaneously with providing the pulling force.

It is a further object of the invention to provide a method for removing and replacing a wall tie.

According to a second aspect of the invention, the method according to the first aspect is extended to include replacing the wall tie by a substitute tie, by inserting a substitute tie into the inner and outer leaves of the wall, applying a settable material to retain the substitute tie in the inner leaf and replacing the originally removed masonry element using a settable material capable of simultaneously securing the substitute tie and the masonry element in the outer leaf.

The insertion of the substitute tie may be preceded by the step of drilling a hole in the masonry of the inner leaf using a drill inserted through the opening in the outer leaf.

The hole is preferably drilled in a brick, block or like element of the inner leaf. Since wall ties which are built into a leaf during the construction of that leaf are embedded in mortar of joints in the leaf, a hole drilled into a brick or other element of the inner leaf will normally be at a level other than that previously occupied by the wall tie which has been removed.

The settable material may be introduced into the hole either before or after insertion of the substitute tie.

The hole may be inclined at an angle of less than 50° to the outer face of the inner leaf.

The settable material capable of simultaneously securing the replacement tie and the masonry element may be an expandable grout.

It is a further object of the invention to provide a tool for removing a wall tie.

According to the invention there is provided a tool for removing a wall tie from a wall in which a part of the wall tie is embedded, the tool comprising wall tie gripping means adapted to grip the tie, abutment means adapted to abut the wall and force exerting means adapted to exert a pulling force on the wall tie by reaction against the wall.

The force exerting means may comprise a manually operated mechanical advantage means such as an operating lever or a screw jack. Alternatively, it may comprise power means such as electric power means or a hydraulic or pneumatic fluid operated piston and cylinder assembly.

The force exerting means may additionally operate the gripping means to grip the wall tie.

In one form, the tool may comprise a pair of levers pivoted together to provide the gripping means.

The levers may have associated cams, movement of which causes relative pivotal movement of the levers.

Piston and cylinder means may be arranged to act on the cams to cause such movement thereof.

The abutment means may be provided by or associated with one end of the piston and cylinder assembly, the other end thereof being arranged to act on said cams.

In another form a pair of pivoted levers may be provided with a screw threaded tightening arrangement to cause them to grip the wall tie from the wall.

At least one pair of projections may be provided on the tool, engageable by an operating lever having a fulcrum acting against the wall to exert said pulling force.

In an alternative form, the tool may comprise a rigid frame having a pivotally mounted gripping jaw cooperable with another jaw to grip the tie, the pivotally mounted jaw being so shaped as to have a wedging engagement with the tie when the tool is subjected to a pulling movement in a sense such as to tend to remove the tie.

The other jaw may be fixed relative to the rigid frame.

Preferably, the pivotally mounted jaw has a plurality of barbs or teeth adapted to bite on the tie to enhance the grip of the jaws on the tie. The fixed jaw may also have barbs or teeth.

The pivotally mounted jaw may be resiliently biased into engagement with the tie.

The piston and cylinder means may act between a portion of the rigid frame and said abutment means.

With all forms of the tool, a load-spreader may be placed against the masonry of the wall to spread the forces exerted thereon.

The load-spreader may be of angle section. It may be provided with a seat to receive the abutment means of the tool.

There is also provided according to the invention a wall tie comprising first and second end portions which, in use, are embedded in respective leaves of a cavity wall and an elongate mid-portion extending between the end portions, wherein the first end portion is substantially flat and parallel to a reference plane which is defined by a surface of the first end portion, the second end portion is spaced substantially from said plane and the mid-portion is arranged with its length inclined to said reference plane.

BRIEF DESCRIPTION OF THE DRAWINGS

The invention will now be described in more detail by way of example only, with reference to the accompanying drawings in which.

DETAILED DESCRIPTION

Figure 1:
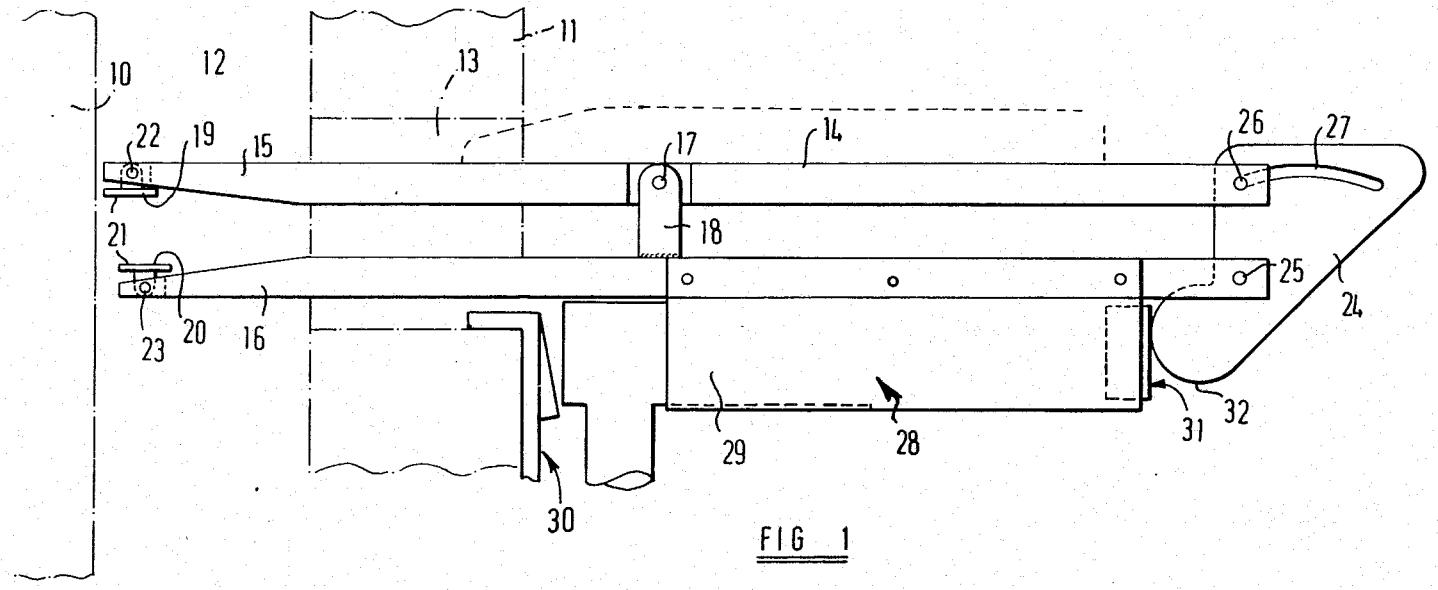
FIG. 1 is a side elevation of a first example of tool for removing wall ties, with the position of an inner and outer leaf of a cavity wall indicated.

Referring firstly to FIG. 1 of the drawings, the positions of the inner leaf 10 and outer leaf 11 of a cavity wall are shown, separated by a cavity 12. Although the wall can be built of any form of masonry element such as bricks or blocks for example, it will be assumed to be a brick wall for purposes of the following description.

During the course of building the brick wall, wall ties (not shown) are laid across the cavity on top of the bricks at a particular level and are then held in place by the mortar in which the next courses of bricks in the inner and outer leaf respectively are bedded. After a period of exposure to moisture, particularly penetrating the mortar of the outer leaf 11, the wall tie may corrode as referred to above and may start to expand and lift the courses of bricks above the position of the wall tie.

In order to carry out remedial work, the wall tie can be removed by the method of the invention in the following manner.

Firstly, a metal detector is used from the outside of the outer leaf 11 to detect the approximate positions of the wall ties which are likely to be faulty. It can frequently be seen by cracking of the mortar and lifting of the superimposed brickwork that particular ties are in a poor condition through corrosion. The metal detector merely locates the position of the wall tie along the course of brickwork where the cracking can be seen to be taking place.

Using a power driven chisel for example, the mortar is then removed around the entire periphery of one brick positioned immediately adjacent the faulty tie and the brick is removed. The position of the brick removed is indicated by the space 13 in the drawings.

When the brick has been removed from 13, visual inspection of the condition of the tie can be made. Any loose or completely failed parts of the tie can be removed or may come away with the mortar when the brick is removed. The remaining portion of the tie within the cavity can be expected, however, to be held fairly firmly between the courses of bricks in the inner leaf 10. This end portion of the tie is unlikely to be very heavily corroded because the cavity has prevented moisture from reaching it in substantial quantities.

A tool 14 is introduced into the space 13 left by the removed brick and is used firstly to grip the remains of the original wall tie and secondly to exert a pulling force which pulls the old tie out of the inner leaf 10 of the wall.

FIG. 1 shows a tool 14 which comprises a pair of levers 15 and 16 which are pivoted together at a pivot 17. The arrangement is that the lever 15 is pivotally mounted on the pivot 17 which is provided between a pair of upstanding lugs 18 on the lever 16.

The levers 15 and 16 are provided with gripping pads 19 and 20 respectively mounted on the levers for limited movement relative thereto. The gripping pads have serrated surfaces 21 intended to make good gripping contact with the tie. Each pad 19, 20 is provided at a respective pivot point 22, 23 to its associated lever 15 or 16. This enables the positions of the pads to accommodate variations in surface shape of the tie, which may be corroded, or variation in the attitude of the levers relative to the tie.

The pivoted levers 15 and 16 can be moved towards or away from each other under the control of a cam 24 provided at the ends of the levers remote from the gripping pads 19 and 20. The cam 24 is pivoted at 25 to the lever 16. A follower pin 26 provided on the lever 15 is movable in an arcuate slot 27 which forms the cam track of the cam 24.

The cam is operated in use by a fluid operated, preferably hydralic, piston and cylinder assembly 28. This is mounted on the underside of the lever 16 by means of a sleeve 29. The base of the hydraulic ram provides an abutment which abuts against a seat on a load-spreader 30 bearing on the masonry of the outer leaf 11 of the cavity wall. The load spreader preferably has a length in excess of 250 mm. The piston indicated at 31 bears on an arcuate face 32 of the cam 24.

In use, the tool 14 is inserted through the space 13 left by removal of a brick from the outer leaf 11. The gripping pads 19 and 20 are positioned around the remains of the original tie, preferably at a position within the cavity 12. The piston and cylinder assembly is then operated which causes the base of the ram to abut the plate 30 at the outer leaf of the wall and causes the piston 31 to press on the arcuate face 32 of the cam 24. As the piston and cylinder assembly extends in length, the cam 24 is forced to rotate about its pivot 25 and the follower pin 26 is forced by the slot 27 to move away from the pivot 25. At the other end of the levers 15 and 16, the gripping pads 19 and 20 are forced into clamping engagement with the tie and the serrated surfaces 21 tend to bite into the surface of the tie so that it is very firmly held. When the gripping pads 19 and 20 are engaged as firmly as is possible, the continued operation of the piston and cylinder assembly still tends to force the piston 31 away from the load-spreader 30 at the outer leaf of the wall where the base of the cylinder is situated. Since no further rotation of the cam 24 can take place because the levers are fully engaged with the tie, the cam 24 is pushed longitudinally away from the wall, thereby exerting a pulling force on the tie clamped between the remote ends of the levers. The hydraulic means therefore, by reaction against the rigid masonry of the outer leaf 11 of the wall, pulls the tie out of the inner leaf 10.

It will be noted that the pivot 17 is spaced at least as far from the pads 19 and 20 as is the base of the ram. The ram can move the levers from a position in which the pads 19 and 20 lie 100–150 mm from the base of the ram to a position in which the pads are adjacent to the base of the ram.

For simplicity of description, the levers 15 and 16 are referred to as single members but it will be appreciated that they can be made of an assembly of parts and in particular that they will have some thickness considered in the horizontal plane in use, so that the wall tie can be conveniently gripped.

In order to prevent buckling of the levers themselves, it may be necessary to provide strengthening ribs or additional strengthening plates welded onto the levers as indicated by a broken line in FIG. 1.

Figure 2:
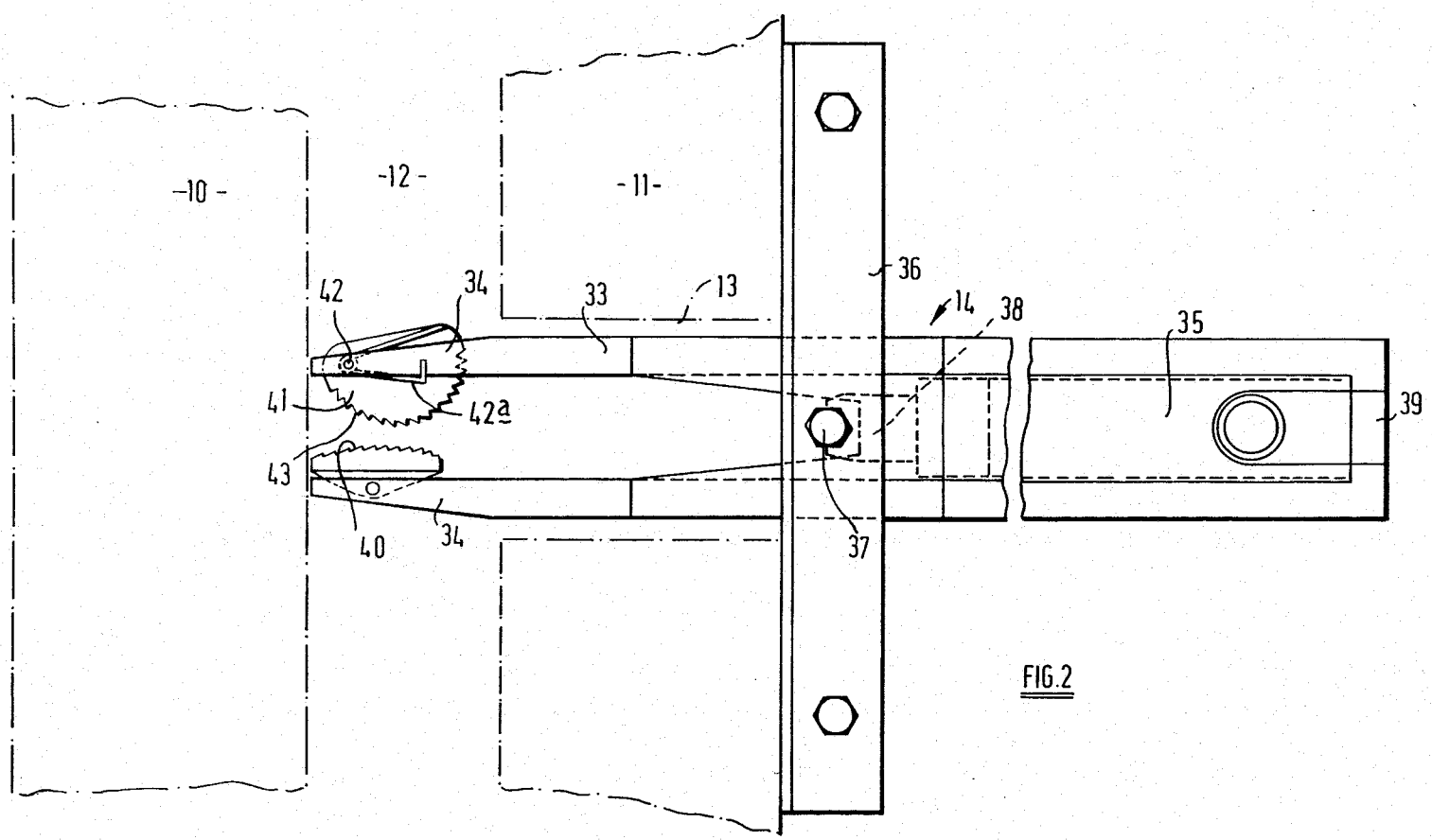
FIG. 2 is a side elevational view of a further example of tool.

Referring to FIG. 2 of the drawings, there is shown a cavity wall of which the parts carry the same references as the corresponding parts of FIG. 1.

The tool 14 has a different construction and operates in a slightly different manner. The tool 14 includes a rigid frame 33 which comprises a generally U-shaped member and which terminates in a pair of tapering forward jaws 34. The jaws are fixed in position relative to each other. A piston and cylinder assembly 35 is mounted within the rigid frame 33. The frame carries abutment means 36 in the form of a pair of angle section elements, which have the fucntion of spreading the force exerted on the outer leaf of the wall 11. The angle section members are connected together by three pins, one, 37, of which is pivotally engaged by the piston 38 of the assembly 35. The cylinder abuts the closed end 39 of the generally U-shaped rigid frame 33.

The gripping means for gripping the original tie is not directy power operated. It comprises a centrally pivoted gripper pad 40 and a pivotally mounted gripper 41, mounted on respective ones of the jaws 34 of the frame 33. The gripper pad 40 has a plurality of teeth or barbs which face towards the piston and cylinder assembly at the remote end of the tool. The pivotally mounted gripper is pivotally mounted at 42 and has a generally part-spiral wedging face 43 which is again provided with a plurality of barbs or teeth facing towards the piston and cylinder assembly at the remote end of the tool. The pivotally mounted gripper is resiliently biased by spring means **42*a* in a generally clockwise direction about the pivot 42**, as seen in the drawings.

In use, the tool is inserted through the space 13 left by removal of a brick from the outer leaf 11. The fixed and pivotally mounted grippers are pressed onto the remnants of the original wall tie (not shown) in such a way that it is pushed between these jaws and it will be appreciated that the pivotally mounted gripper 41 is spring urged against the tie so that the latter is resiliently held between the grippers. The tool is preferably pushed towards or up to the inner leaf so that the tie is gripped at a position within the cavity 12.

The abutment 36 abuts against the masonry of the outer leaf 11 and provides a large area of contact over which the force of the piston and cylinder assembly can act. The operation of the piston and cylinder assembly causes the abutment 36 to be pushed away from the closed end 39 of the rigid frame 33. The rigid frame 33 is subjected to a pulling force due to the reaction of the rigid outer leaf of the wall against the abutment 36.

As the frame 33 is pulled away from the inner leaf 10 of the wall, the pivotally mounted gripper 41 in engagement with the tie tends to be pulled forwardly relative to the frame, that is towards the inner leaf. However, this movement cannot be contemplated because the wedging face 43 becomes firmly wedged against the upper surface of the tie, the underside of which is engaged with the gripper pad 40. The tie therefore becomes wedged firmly between the two grippers 40 and 41 and the barbs or teeth of these grippers bite into the material of the tie. The pulling force exerted on the frame 33 then acts on the tie to pull it out of the mortar of the inner leaf 10 of the cavity wall.

In a modification (not shown) the angle section elements forming the abutment means 36 are disposed horizontally in use, not vertically as shown. The central pin 37 is replaced by a bolt which, in addition to supporting the abutment means 36 and engaging the piston 38, also serves to hold the limbs of the rigid frame 33 more rigidly in position. This arrangement may be preferred in some conditions of use.

Although the preceding description has dealt with power operated tools, it is possible to provide a relatively simple manually operated tool for removing the wall ties. The ties are located and a brick is removed from the outer leaf as before.

Figure 5:
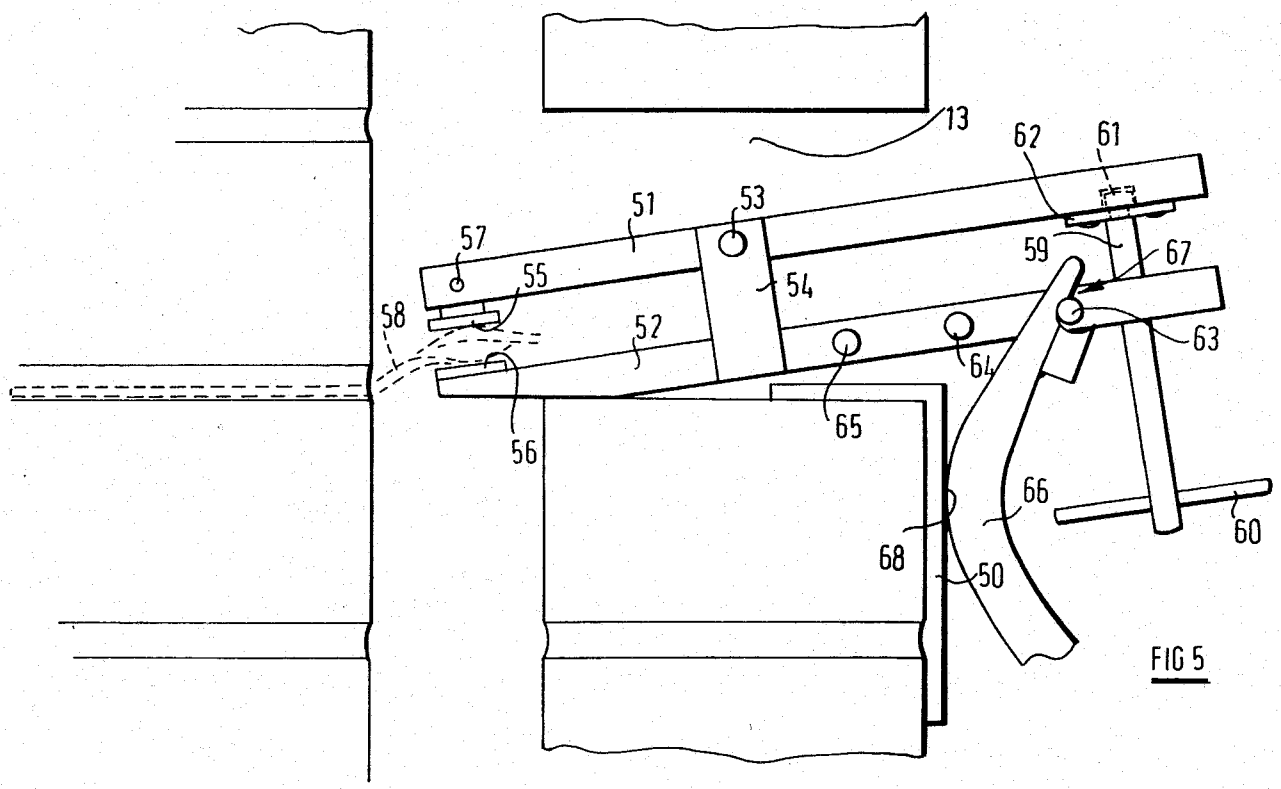
FIG. 5 is a side elevation of a further example of tool, this example being a manually operated tool.

FIG. 5 of the drawings illustrates the tool in use. A load-spreader 50 of generally angle section heavy sheet metal is placed over the masonry of the outer leaf below the space 13 in which the tool operates. The spreader plate 50 is intended to spread the load exerted on the masonry across a substantial area so as to avoid damaging the masonry or causing the brick immediately below the space 13 to be dislodged.

The tool comprises a pair of levers 51, 52 pivoted about a pivot point 53 provided on upstanding brackets 54 of the lower lever 52. It is provided with a pair of gripping jaws 55, 56, at least the jaw 55 being pivoted at 57 to one of the levers so as to accommodate variations in the shape and size of the tie to be removed. The position and general outline of the tie is indicated in dotted lines at 58.

The gripping jaws 55 and 56 are forced into firm engagement with the tie by screw-threaded means associated with the remote ends of the levers. A threaded pin 59 is rotatable by means of a tommy bar 60. A headed portion 61 of the pin is held captive by a plate 62 in a recess of the upper lever 51. Internal screw threads are provided on the lower lever 52 so that rotation of the pin 59 by the tommy bar 60 causes relative movement between the levers. As the lever ends are forced apart by the threaded pin 59, the gripping jaws 55 and 56 are forced into firm gripping engagement with the wall tie 58. The jaws are again serrated.

The lower lever 52 is provided with a plurality of pairs of laterally extending pins 63, 64, 65. A hand operated lever or jemmy 66 is adapted to engage the pairs of pins as illustrated at 67. By forcing the lower end of the jemmy 66 downwardly, the upper end is forced away from the wall tie so that the tool is subjected to a pulling force. This is derived from reaction forces exerted by the wall, as protected by the spreader plate 50, on the fulcrum 68 of the jemmy.

When the jemmy has been forced downwardly a certain distance, the pins 63 have been pulled so far from the wall that further leverage cannot be exerted on them and the jemmy is then disengaged and re-engaged with the pair of pins 64, the process continuing until the wall tie 58 has been fully removed from the wall.

Figure 3:
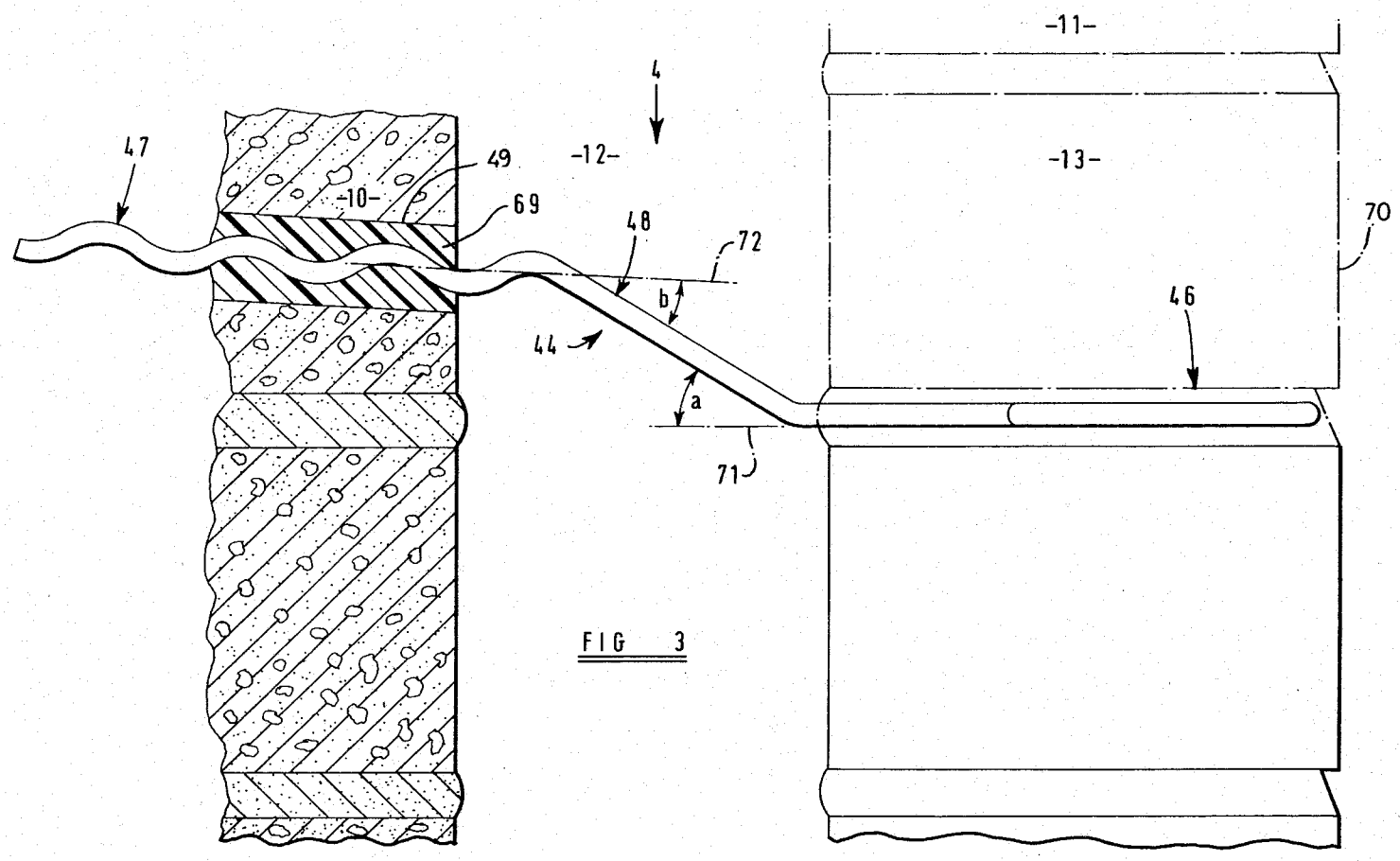
FIG. 3 is a vertical section through a wall diagrammatically illustrating the replacement of a wall tie by a substitute tie.
Figure 4:
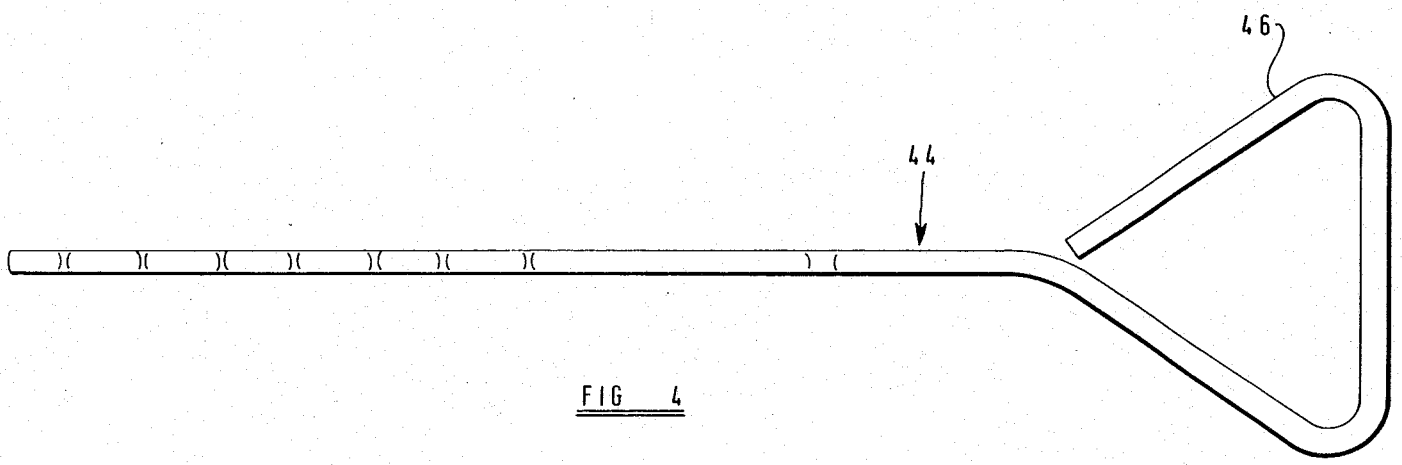
FIG. 4 is a plan view of the wall tie of FIG. 3.

In order to reconnect the inner and outer leaves of the wall, a substitute tie is inserted. Referring to FIGS. 3 and 4 of the drawings, a substitute tie is shown at 44. The tie comprises an outer end portion 46, an inner end portion 47 and a mid portion 48 extending between the end portions.

The replacement tie 44 is not inserted in the mortar of the inner leaf but into a hole which is drilled into one of the bricks or other masonry elements. This hole is shown at 49, and is drilled by means of a power drill inserted through the space 13 left by removal of a brick from the outer leaf. The hole is preferably inclined upwardly in a direction away from the outer leaf. The hole is then filled with a settable material which is preferably an epoxy resin mortar 69. It is preferred that this is done before the inner end portion 47 of the tie is introduced into hole 49 but it may be done afterwards if suitable means can be used for ensuring good penetration of the epoxy resin mortar around the tie.

The wall repair is completed by re-inserting the removed brick at 70, as shown by a broken line in FIG. 3. The outer end portion 46 of the substitute tie is embedded in a layer of mortar on which the brick 70 is bedded. This can be an expandable mortar which may be used on all faces of the brick 70.

It will be appreciated that, since the original brick has been replaced, there is no trace of the remedial work which has been carried out other than the fresh mortar surrounding the brick. This can either be allowed to weather so as to merge in with remaining mortar or, after the remedial work has been carried out on the wall, the whole wall can be repointed with fresh mortar.

It has been found that, by the use of an epoxy resin mortar, the substitute tie 44 can be very firmly embedded in the brickwork of the inner leaf 10. In comparison with known types of substitute tie relying on frictional or mechanical engagement, the attachment of the tie to the inner leaf is much more secure and is not substantially loosened by vibration or the normal loading encountered by the tie in use.

As shown in FIG. 3, to enhance the strength of the connection between the wall tie 44 and the inner leaf 10, the inner end portion 47 of the wall tie is non-rectilinear and is shown in FIG. 3 as wavy. Additionally, or alternatively, the inner end portion may have a non-uniform cross-section so that narrow parts of the tie alternate with wide parts along the length of the inner end portion. As shown, the preferred form of the inner end portion is undulate.

To facilitate positioning of the outer end portion 46 of the substitute tie in a joint of the outer leaf 11, the outer end portion is substantially flat. Corresponding joints in the inner and outer leaves of a cavity wall are usually at the same level. Since the inner end portion 47 of the wall tie is required to be inserted in a hole 49 drilled in an element of the inner leaf above the level of the joint in which the outer end portion 46 is embedded, the inner end portion 47 is spaced from a reference plane 71 defined by a surface, for example the lower surface, of the outer end portion 46. Preferably, the spacing between this plane and the inner end portion is at least 15 mm and more preferably at least 20 mm.

The mid portion 48 of the wall tie is elongated and, preferably, rectilinear. The mid portion is inclined to the reference plane 71, the acute angle a included between this plane and the mid portion preferably having a value of at least 25° and, more preferably, a value between 30° and 40°. Although the inner end portion 47 is non-rectiliner, it can be seen from FIG. 3 that this end portion, considered as a whole, is generally parallel to a medial axis 72 of the end portion. As shown, the axis 72 is preferably inclined to the plane 71 at a small angle, typically within the range 1° to 10°. Thus, the acute angle b between the axis 72 and the mid portion 48 is typically within the range 20° to 35° and preferably within the range 25° to 30°. It will be noted that the angle a exceeds the angle b.

The substitute wall tie 44 is conveniently formed of round, stainless steel wire. As shown in the drawing, the tie consists of a single piece of wire, the end portion 46, the mid-portion 48 and the end portion 47 being integral with one another. The end portion 46 is preferably formed, as shown in FIG. 4, to a substantially closed loop and has a width, that is the dimension extending along the length of the cavity wall, many time greater than the width of the inner end portion 47. As viewed in plan, the inner end portion 47 and the mid portion 48 are rectilinear.

The upward inclination of the mid portion 48 in a direction from the outer leaf 11 towards the inner leaf 10 ensures that water cannot run along the mid portion of the wall tie from the outer leaf to the inner leaf of the wall.

It will be appreciated that details of tools and methods referred to in the foregoing description may be changed to suit particular applications, without departing from the scope of the invention.

I claim:

1. A method of tying together two leaves of an old cavity wall having inner and outer leaves, with each of the inner and outer leaves having a plurality of masonry elements bonded together with a jointing medium, comprising:

removing a masonry element from the outer leaf, thereby forming an opening therein;

boring a hole in a masonry element in the inner leaf through the opening in the outer leaf;

inserting a wall tie, having first and second ends and an elongated mid-portion extending between the end portions, into the opening and inserting and embedding the tie second end in the bored hole in the inner leaf masonry element;

positioning the tie first end along the joint surface of the masonry element adjacent the opening in the outer leaf;

inserting a masonry element in the opening in the outer leaf; and placing jointing medium in the joints around the inserted masonry element to embed it in the outer leaf.

2. An old rehabilitated cavity wall comprising inner and outer leaves reinforced by wall ties installed after the wall has been completed;

each of the inner and outer leaves comprising a plurality of masonry elements bonded together with a jointing medium;

the inner and outer leaves being tied together by a plurality of single piece wall ties;

each wall tie comprising first and second end portions and an elongated mid-portion extending between the end portions;

the tie first end portion being substantially flat and parallel to a reference plane which is defined by a surface of the first end portion;

the second end portion being spaced substantially from said plane and the mid-portion being arranged with its length inclined at an acute angle to said reference plane;

the tie second end portion being embedded in a hole bored in a masonry element of the inner leaf of the cavity wall;

the tie first end portion being embedded in a joint between, and not in, two adjacent masonry elements of the outer leaf of the cavity wall;

the tie second end portion being at a different level than the joint in which the tie first end portion is embedded; and one of the two adjacent masonry elements fills an opening in the outer leaf made when the tie in installed.

3. A method of tying together inner and outer leaves of a cavity wall using a wall tie comprising first and second end portions which, in use, are embedded in the respective leaves of a cavity wall and an elongated mid-portion extending between the end portions wherein the first end portion is substantially flat and parallel to a reference plane which is defined by a surface of the first end portion; the second end portion is spaced substantially from said plane and the mid-portion is ararnged with its length inclined at an acute angle to said reference plane; and the second end portion, considered as a whole, is along an axis inclined at an acute angle to the said reference plane of the first end portion;

the method comprising boring a hole in a masonry element of the inner leaf of said wall from the cavity, introducing said second end portion of the wall tie into said hole and securing it therein by a settable material, incorporating a masonry element in the outer leaf of the wall, bedding the masonry element therein on a bed of settable material which ties to the outer leaf at a level different from the level of the bored hole and wherein said first end portion of wall tie is embedded in said bed of settable material.

* * * * *